United States Patent [19]

Ren

[11] 4,368,888

[45] Jan. 18, 1983

[54] GOLF PUTTING DEVICE

[76] Inventor: Gerald J. Ren, 653 Massachusetts Ave., Riverside, Calif. 92507

[21] Appl. No.: 233,019

[22] Filed: Feb. 9, 1981

[51] Int. Cl.[3] ..... A63B 69/36

[52] U.S. Cl. ..... 273/176 FB; 273/177 R

[58] Field of Search ..... 273/176 FA, 176 FB, 273/176 F, 176 FC, 176 B, 177 R, 177 A, 180, 87 C, 87 B, 176 H, 176 J

[56] References Cited

U.S. PATENT DOCUMENTS

| | | | |
|---|---|---|---|
| 3,342,495 | 9/1967 | Wasley | 273/176 F |
| 3,464,699 | 9/1969 | Dollar | 273/177 R |
| 3,464,704 | 9/1969 | Nelson | 273/176 F |
| 3,891,221 | 6/1975 | Gordon | 273/177 R |

FOREIGN PATENT DOCUMENTS

| | | | |
|---|---|---|---|
| 220377 | 8/1924 | United Kingdom | 273/176 J |

*Primary Examiner*—George J. Marlo

*Attorney, Agent, or Firm*—John H. Crowe; Fred N. Schwend

[57] ABSTRACT

An elongate putting strip having a rebound block at one end thereof with a number of rebound faces at different widths arranged therearound. The block may be rotatably adjusted to present any of its faces to the length of the strip to require different degrees of putting skill. The rebound block also effective lengthens the putting path for the ball being driven along the strip. Each face of the rebound block is inclined relative to the vertical and the block has a layer of heavy, dense material positioned high enough to be struck by the ball to enhance the rebound action of the latter. The strip is hinged so that it may be folded into a compact package for carrying or storing purposes.

5 Claims, 8 Drawing Figures

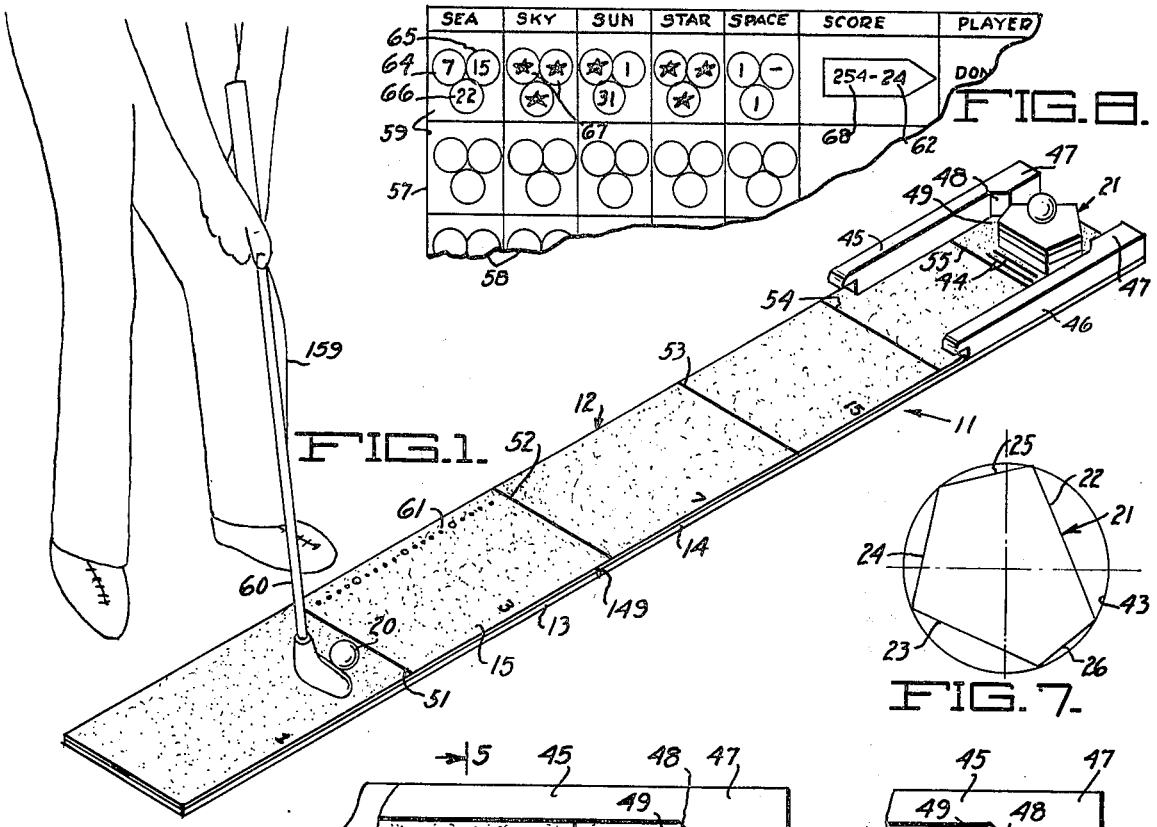
FIG. 1.
FIG. 8.
FIG. 7.
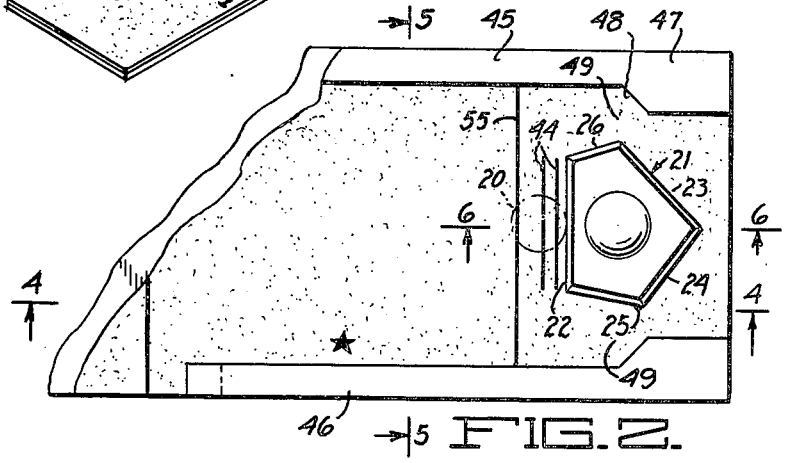
FIG. 2.
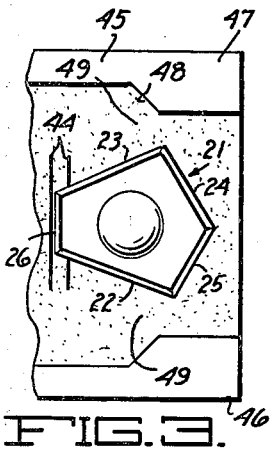
FIG. 3.
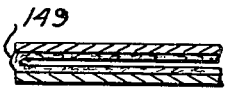
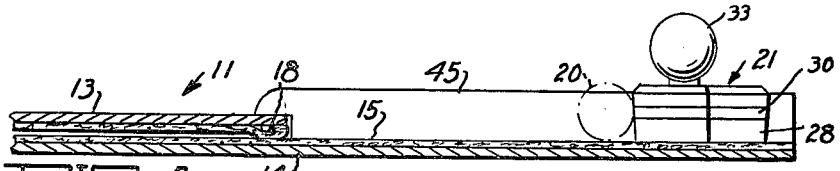
FIG. 4.
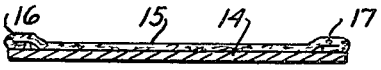
FIG. 5.
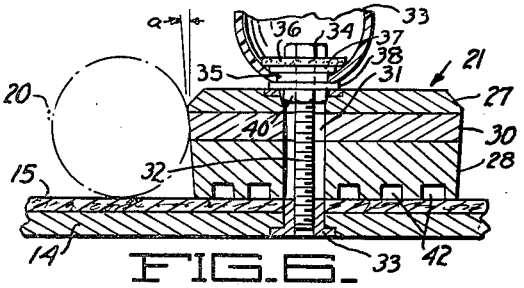
FIG. 6.

GOLF PUTTING DEVICE

BACKGROUND OF THE INVENTION

1. Field of the Invention

This invention relates to the field of golf and has particular reference to a portable device for practicing putting and for playing games involving putting.

2. Description of the Prior Art

Putting generally requires a putting green having a relatively large area which normally restricts its use to large outdoor areas. Also, the act of putting requires skill in driving a golf ball both in a precise direction and over a precise distance toward a target which is generally in the form of a cup. Since golfers appreciate the fact that frequent practice is necessary to maintain or improve their skill in putting, many portable devices have been proposed heretofore that utilize an elongate carpet or the like which can be laid down either indoors or outdoors to simulate part of a putting green. Usually such putting devices have one or more cups at one end to receive the ball. The golfer or putter drives the ball over the carpet from the opposite end in an attempt to drop the ball into the cup.

Although such prior art devices are generally satisfactory, they do not truly simulate conditions found on a natural and full size outdoor putting green. For example, such greens may require putts of up to 30 feet in length or more and carpets of that length would generally be impractical for indoor practice. Also, those prior putting devices of which I am aware do not provide means for varying at will the amount of putting precision required in order to satisfy the practice requirements of both a beginner and an accomplished putter.

SUMMARY OF THE INVENTION

A principal object of the present invention is to provide a compact, portable putting device which may be used either indoors or outdoors to increase a putter's skill.

Another object of the invention is to provide a compact putting device of the above type effective to simulate a putting green of considerably greater length than the device.

Another object of the invention is to provide a putting device of the above type in which the degree of skill required to reach a target may be varied as desired.

Another object of the invention is to provide a putting device of the above type in which the accuracy required in both putting direction and putting distance may be varied.

A further object of the invention is to provide a putting device which may be used by two or more putters in a competitive game requiring putting skills.

BRIEF DESCRIPTION OF THE DRAWING

The manner in which the above and other objects of the invention are accomplished will be readily understood on reference to the following specification when read in conjunction with the accompanying drawing, wherein:

FIG. 1 is a perspective view of a putting device embodying a preferred form of the present invention, and showing the device in unfolded condition.

FIG. 2 is a top plan view of the putting device, partly broken away.

FIG. 3 is a top plan view similar to FIG. 2 but wherein the rebound block is set in a different position.

FIG. 4 is an enlarged longitudinal sectional view, with parts broken away, of the putting device and is taken along the line 4—4 of FIG. 2, the device being shown in folded condition.

FIG. 5 is a transverse sectional view taken along line 5—5 of FIG. 2.

FIG. 6 is an enlarged sectional view through the rebound block and surrounding part of the putting strip, and is taken along the line 6—6 of FIG. 2.

FIG. 7 is a schematic view illustrating the geometrical formation of the rebound block.

FIG. 8 is a view, partly broken away, showing a chart to be used in a typical game to be played by two or more putters in using the putting device of the present invention.

According to the invention, an elongate putting strip is provided having a rebound block at one end thereof. The block has a number of rebound faces therearound of different widths and is rotatably adjustable about a vertical axis to position any of its faces in the path of a golf ball driven along the strip by the putter. One of the faces has a width substantially equal to the diameter of a standard ball receiving cup. The other faces, however, are of progressively shorter widths, thus requiring progressively greater skills in driving the ball to the target, i.e., the rebound block.

The rebound block comprises a layer of dense material, preferably lead, which is located at a height to be struck by the ball as it rolls along the putting strip in order to enhance rebound thereof. Also, such rebound faces incline downwardly toward the center of the block at a preferred acute angle to further enhance rebound of the ball along the length of the strip.

Thus, the effective length of the putting strip is substantially twice its actual length, enabling the device to simulate a putting green having a much greater length than the length of the device.

Further, the device may be folded into a compact package for carrying or storing purposes.

DESCRIPTION OF THE PREFERRED EMBODIMENT

Although this invention is susceptible to embodiment in many different forms, there is shown in the drawing and will be described one specific embodiment with the understanding that the present disclosure is to be considered as an exemplification of the principles of the invention and is not intended to limit the invention to the embodiment shown. The scope of the invention will be pointed out in the appended claims.

Referring to the drawing, the putting device is generally indicated at 11 and comprises an elongate putting strip 12 preferably on the order of 10 inches wide and 76 inches long. The strip is formed of two elongate backing layers 13 and 14 of a relatively thin, stiff and hard material such as plywood, plastic, or the like. The layers 13 and 14 are laid end to end and a one-piece flexible carpet 15 is secured thereover as by a suitable adhesive. The carpet may be of any suitable fabric material which may resemble the close cropped surface of a natural "moderately fast" putting green. I have found, however, that a carpet of the well-known "indoor-outdoor" type comprised of loosely woven 100 percent polypropylene fibers is admirably suited for the purpose. This is available under the proprietary name "Ensign" and is manufactured by the Armstrong Cork Company of Lancaster, Pa.

As seen in FIGS. 4 and 5, the upper surface of the carpet 15 is generally flat but the outer edges of the carpet are turned back upon themselves at 16, 17 and 18 to form raised boundary edges to normally retain a golf ball 20 from rolling off the carpet unless it is rolling at an excessive speed.

A rebound block generally indicated at 21 is provided at one end of the carpet 15. Such block has five rebound faces 22, 23, 24, 25 and 26 arranged therearound of progressively shorter widths. Such block is preferably of laminated construction comprising upper and lower layers 27 and 28 (FIG. 6) of a relatively light, low density material such as fiberboard, wood, or the like and an intermediate layer 30 of a relatively heavy, dense material, preferably lead. Such layers 27, 28 and 30 are secured together by a suitable adhesive.

It will be noted that the intermediate layer 30 is located at a height substantially equal to the radius of the ball 20 and preferably has a thickness on the order of 5/16 inches so as to be struck by the ball as it rolls along the carpet 15, to effect a maximum rebound of the ball. Also, each rebound face of the rebound block 21 is inclined vertically toward the center of the block along an acute angle a to a vertical plane of from about $3\frac{1}{2}$ to about $4\frac{1}{2}$ degrees. This inclination has been found to enhance the rebound action of the ball from the block by obviating any tendency for the ball to bounce upwardly off of the carpet 15, as would occur if the face were vertical. It has been found that any degree of inclination of the rebound face beyond about $4\frac{1}{2}$ degrees will tend to drive the ball into the carpet and thereby retard its rebound movement.

The rebound block 21 is pivotal about its center and about a vertical axis extending through the strip 12 midway between the side edges of the strip. For this purpose, the block 21 has a vertical hole 31 therethrough adapted to receive a clamp screw 32 threaded in a flanged nut 33 fixedly embedded within the backing layer 14 and extending through the carpet 15. The upper end of the screw 32 is attached to a spherical, thin-shelled plastic knob 33, preferably simulative of a golf ball. For this purpose, the head 34 of screw 32 is passed through an opening 35 in the knob 33 and bears against a rubber washer 36 to clamp a pair of metal washers 37 and 38 against the wall of the shell and against a nut 40 threaded on the screw 32 and rotatably mounted in the opening 31. Rebound block 21 can be easily fastened in any desired position of rotation about clamp screw 32, or loosened for rotation to another position, by slight hand turning of the knob 33 in the proper direction for the desired purpose. The size of knob 33 provides sufficient leverage to make such adjustment easy for virtually anyone.

For the purpose of aiding the clamp screw 32 in securing the rebound block 21 against rotation when struck by the ball 20, a number of holes 42 are formed in the lower layer 27 of the block so that when the latter is clamped against the carpet 15, the carpet will partially extend into the holes 42 to resist relative movement of the block.

As shown in FIG. 7, the rebound block 21 is formed within a circle 43 having a radius preferably on the order of $2\frac{5}{8}$ inches. The various faces 22 to 26 are formed as adjoining chords of such circle and preferably progressively vary in width from $4\frac{1}{8}$ inches (face 22) to $1\frac{3}{4}$ inches (face 26). Thus, it will be seen that when the block 21 is rotatably adjusted to present any of the faces thereof at right angles to the length of the strip 12 (as seen in FIGS. 2 and 3 for example), such face will be centered relative to the width of the strip.

The rebound face 22 is of a width substantially equal to the diameter of a standard golf ball cup and thus, if struck squarely by the ball 20, this will simulate entry of the ball into a cup.

For the purpose of aiding in setting the block 21 to present a selected face at right angles to the length of the strip 12, a pair of reference lines 44 are printed on the carpet 15 at right angles to the length of the strip and the block 21 is adjusted until the selected face is parallel to the lines.

A pair of containment rails 45 and 46 are suitably secured to the strip 12 along the side edges of the latter. Such rails extend past the rebound block 21 and have thickened portions 47 joined by inclined shoulders 48 to the main portions of the rails. Such rails prevent passage of the ball 20 between the block 21 and the rails in all adjusted positions of the block and thus normally trap the ball in one of a pair of pockets 49 formed between the block and the rails in the event it misses a rebound face of the block.

The mid-portion of the carpet 15 opposite the adjacent ends of the backing layers 13 and 14 forms a hinge at 149, permitting the backing layers 13 and 14 to be folded together as seen in FIG. 4. For the purpose of locking such layers in folded condition for carrying or storing purposes, notches 50 are formed in the ends of the containment rails 45 and 46 to receive the free end of the backing strip 13. The hinge portion 149 of the carpet 15 permits a slight movement of the backing layer 13 relative to the layer 14 to release the layer 13 from the notches 50 when desired.

Lines 51, 52, 53, 54 and 55 are printed across the carpet 15 to define zones of progressively closer proximity to the block 21 denoted by indicia "1," "3," "7," "15" and a star, respectively.

Although the putting device 11 may be used by one or more putters in an obvious manner to improve his or their putting skills, it may be also used to play competitive games requiring putting skills.

In a typical game, a score card 57 is used having a number of vertical columns 58, one for each of the faces of the rebound block. These are identified by the headings: SEA; SKY; SUN; STAR; and SPACE. These correspond respectively to the rebound faces 22, 23, 24, 25 and 26 of the block 21. The card is divided into horizontal rows 59, one for each player.

The game is started by setting the block 21 to present its widest face 22 to the strip, as shown in FIG. 2. The players then "lag for honors" in which a first player takes a stance similar to that shown at 159 in FIG. 1 but with a putter club 60 and the ball 20 located behind the tee line 52. He then putts the ball in an attempt to cause the ball to rebound from the block 21 into the zone "3," as close to the line 51 as possible. A scale 61 printed on carpet 15 aids in indicating the lag score. However, if the player fails to drive his ball into zone 3, he must relag and for each relag add 20 to his first successful lag score. The total lag score for the first player is recorded at 62 on the chart 57 and the lag scores for the remaining players are similarly recorded. Such lag scores determine the order in which the players start the game. The player with the best lag score then putts from the tee line 52, driving the ball against the block 21 in an attempt to land it in the zone 1. If successful, he repeats the operation attempting to place it in the next zone (3) and so forth. The last zone, designated by a star establishes a count of 30. Whenever the player misses landing his ball in a proper zone, the number of the last zone in which he successfully landed the ball is placed in a left hand circle 64 in the first column 58 of the chart 57. The player then follows the same procedure as before but drives the ball 20 from the rearmost tee line 51 and, again, when he misses a proper zone, he records the number of the last zone in which he succeeded, in a right hand circle 65 of the same column 58. The sum of the two scores is then added and entered in a third (lower) circle 66 of the same column 58 and the next player takes his turn and his score is entered in the next lower horizontal row 59 on the score sheet 57.

In the event the highest possible score is reached in any play, a star is recorded in the appropriate circle on the score sheet, and in the case where a star is recorded in both upper circles, as indicated at 67, it is also recorded in the lower circle 66 of such group. This is termed a "cluster" and is worth 90 points. When two clusters are recorded in a row 59 the value of each cluster is upgraded in value to 100.

When putting is completed with the rebound block 21 set in its first position with its face 22 presented to the strip 12, the block is rotatably adjusted until its next face 23 is presented to the strip and the foregoing procedure is repeated, the scores being recorded in the second one of the columns 58.

When the game is completed, the scores recorded in the lower circles 66 in each horizontal row are added and recorded at 68. Where two or more players have the same scores at 68 the lag scores at 62 determine the outcome of the game, the one with the lowest lag score being the winner, the one with the next lowest score being the runner-up (or loser where there are only two participants), etc.

In order to make the game more interesting and easier to follow, the faces 22, 23, 24, 25 and 26 of the rebound block 21 can be partially painted green, blue, yellow red and black, respectively, thus making it easy to correlate the various faces of the block with the corresponding sea, sky, sun, star and space columns (58) of the score card 57.

It will be obvious that other games, including "solitaire" games for a single individual, are playable with the device of the present invention.

I claim:

1. A portable putting device for use with a ball and putting club, comprising:

an elongate strip forming a putting surface, a rebound block adjacent one end of said strip, said block having a plurality of planar rebound faces of different widths, and means for securing said block to said strip to position any of said rebound faces at right angles to the length of the strip whereby to rebound said ball along said strip, said means comprising clamping means for clamping the rebound block to the strip in different positions about a vertical axis extending through said block and said strip, said rebound faces comprising chords of a circle having its center coincident with said axis.

2. A portable putting device for use with a ball and putting club, comprising:

an elongate strip forming a putting surface, a rebound block adjacent one end of said strip, said block having a plurality of planar rebound faces of different widths, and means for securing said block to said strip to position any of said rebound faces at right angles to the length of said strip whereby to rebound said ball along said strip, each of said rebound faces on the secured block being inclined downwardly toward the center of said block and at an acute angle to a plane extending at right angles to the upper surface of said strip.

3. A portable putting device as defined in claim 2 wherein said acute angle is between about $3\frac{1}{2}$ and about $4\frac{1}{2}$ degrees.

4. A portable putting device as defined in claim 2 wherein said rebound block comprises a layer of relatively dense material having a weight greater than the weight of said ball, said layer extending in a plane parallel to the plane of the upper surface of said strip and being located at a height above said strip such that said ball will strike the edge of said layer when it hits said rebound block while rolling along said strip.

5. A portable putting device for use with a ball and putting club, comprising:

an elongate strip forming a putting surface, a rebound block adjacent one end of said strip, said block having a plurality of planar rebound faces of different widths, and means for securing said block to said strip to position any of said rebound faces at right angles to the length of the strip whereby to rebound said ball along said strip, said means comprising clamping means for clamping the rebound block to the strip in different positions about a vertical axis extending through said block and said strip, said portable putting device having containment rails extending along the side edges of said strip and past said rebound block, said containment rails being adapted to prevent said ball from passing between them and said rebound block, said strip comprising a first elongate backing layer, a second elongate backing layer, and a relatively flexible carpet overlaying the first and second backing layers, said carpet forming a hinge between the first and second backing layers whereby said backing layers may be folded, and said containment rails having notches in their ends positioned to receive the folded end of one of the backing layers whereby to retain said backing layers in folded condition.

* * * * *